United States Patent [19]

Flynn

[11] Patent Number: 4,605,495

[45] Date of Patent: Aug. 12, 1986

[54] HYDROCYCLONE SEPARATOR APPARATUS

[75] Inventor: Peter J. Flynn, North Attleboro, Mass.

[73] Assignee: Bird Machine Company, Inc., South Walpole, Mass.

[21] Appl. No.: 692,674

[22] Filed: Jan. 18, 1985

Related U.S. Application Data

[63] Continuation-in-part of Ser. No. 591,761, Mar. 19, 1984, abandoned.

[51] Int. Cl.[4] ..... B04C 3/04; B04C 3/06

[52] U.S. Cl. ..... 209/211; 210/512.2; 55/347

[58] Field of Search ..... 209/211, 144; 210/512.1, 512.2; 55/346, 347, 348, 349, 396, 449

[56] References Cited

U.S. PATENT DOCUMENTS

| | | | |
|---|---|---|---|
| 2,757,581 | 8/1956 | Freeman et al. | 209/211 |
| 2,927,693 | 3/1960 | Freeman et al. | 209/211 |
| 3,243,941 | 4/1966 | Peterson | 210/512.1 X |
| 3,283,480 | 11/1966 | Szego | 209/144 X |
| 3,306,444 | 2/1967 | Troland | 209/211 |
| 3,543,931 | 12/1970 | Rastatter | 209/211 |
| 3,598,731 | 8/1971 | Frykhult et al. | 210/94 |
| 3,861,532 | 1/1975 | Skardel | 209/211 |
| 3,959,150 | 5/1976 | Frykhult et al. | 210/512 M |
| 4,019,980 | 4/1977 | Beery | 209/211 |
| 4,148,721 | 4/1979 | Brown et al. | 209/211 |
| 4,280,902 | 7/1981 | Jacobsen et al. | 209/211 |
| 4,378,289 | 3/1983 | Hunter | 209/211 |
| 4,394,145 | 7/1983 | Sundseth | 55/347 |
| 4,426,283 | 1/1984 | Fecske | 209/211 |
| 4,462,899 | 7/1984 | Wambsgans | 209/211 |

FOREIGN PATENT DOCUMENTS

| | | | |
|---|---|---|---|
| 1159404 | 12/1983 | Canada | 209/85 |
| 0058484 | 8/1982 | European Pat. Off. | 209/144 |
| 1314386 | 12/1962 | France | 209/211 |
| 594576 | 11/1947 | United Kingdom | 55/347 |
| 896131 | 1/1985 | U.S.S.R. . | |

OTHER PUBLICATIONS

Article "The Uniflow Central Cleaning Philosophy in Light Contaminant Removal", by Chivrall and McCool, Proceedings of the TAPPI Pulping Conference, 1983, pp. 685–694.

*Primary Examiner*—S. Leon Bashore
*Assistant Examiner*—Thomas M. Lithgow
*Attorney, Agent, or Firm*—Edgar H. Kent

[57] ABSTRACT

Hydrocyclone separator apparatus includes hydrocyclone separator(s) capable of separating light impurities from a paper-making fiber slurry. The separator inner wall is cylindrical with an apertured inlet portion adjacent one end which directs feed slurry in a vortical path along the wall to an enlarged inlet to an axial flow passage adjacent the other end. This inlet has a rim spaced radially from the wall which skims an inner part from the vortex containing predominantly the light impurities into the axial passage from which it is discharged through an apertured outlet portion of the sidewall. The remainder of the slurry vortex passes the rim to be discharged through another apertured outlet portion of the sidewall. The apparatus also includes manifold structure providing three manifolds having parallel sidewalls with seal-lined openings through which the separator(s) may be endwise inserted to or withdrawn from operative position in which the inlet and outlets thereof are associated with respective manifolds. The outer wall of the separator(s) is reduced in diameter for at least substantially half the length thereof to facilitate separator manipulation and reduce seal wear. One manifold is spaced from the other two by at least substantially half of the separator length to expose the body portion of the separator(s) for hand manipulation.

11 Claims, 11 Drawing Figures

HYDROCYCLONE SEPARATOR APPARATUS

This application is a continuation-in part of pending U.S. application Ser. No. 591,761 filed Mar. 19, 1984 now abandoned.

BACKGROUND OF THE INVENTION

1. Field of the Invention

This invention relates to hydrocyclone separator apparatus. More particularly it relates to such apparatus whereof the individual hydrocyclone or "vortex" separators are useful in separating undesired components from a paper making fiber slurry and wherein the various manifolds for supplying the feed slurry thereto and for removing the separated slurry fractions therefrom are co-designed to fit together in multiple arrays of separators so that individual separators which malfunction may be readily removed and replaced.

2. Description of the Prior Art

Hydrocyclone separators are extensively used in the paper and pulp industry to remove the undesired components denser than the desired fibers, commonly called "heavier" or "heavies". The conventional separator long used for this purpose has an elongated tubular body which is at least in large part conical, with a tangential inlet for slurry to be treated at the larger end, an outlet from the smaller end and an outlet from the inlet end opposite the small end outlet. In this conventional separator, slurry fed into the larger end forms a helical vortex flowing along the inside wall toward the smaller end outlet. The inner portion of the vortex, however, reverses as it approaches the smaller end outlet, forming an inner vortex spiraling about an air core toward the inlet end, where it is removed, along with air from the core, through a central vortex finder, as the larger accept fraction. The smaller reject fraction of the slurry which discharges through the smaller end outlet contains the heavies which the centrifugal force of the vortex forces toward the wall and restrains from entering the inner vortex.

Such separators are efficient, although post treatment of the rejects fraction may be needed to recover a significant desired fraction which it inevitably contains. However, the accepts fraction, though essentially freed of heavies, still contains undesirable components which are not denser than the desired fibers, such as oversize fibers or fiber bundles, and if secondary fibers are a component of the slurry, bits of plastic, glue, gum and the like, commonly referred to as stickies. As disclosed in U.S. Pat. No. 3,306,444, such impurities, commonly referred to as "lighter" or "lights" (although some thereof may have the same density as that of desired fibers), tend to segregate toward the inner part of the reversing vortex. The patent provides a concentric inner vortex finder to separately remove the inner reversed vortex portion containing these impurities, a construction which has proved efficient in cleaning the accepts of these impurities.

A more recent alternative to this patented arrangement is used to clean the slurry of the lighter impurities after it has been cleaned of the heavies by preceding apparatus such as conventional two output separators described above. Such alternative separators now in successful commercial use are similar in body form to the conventional two way separators described above, but dispense with the feed end outlet and reversing vortex, providing instead a concentric outlet around the smaller end reject outlet. The good fibers, which, in view of pre-cleaning, now can be considered the "heavies", segregate under centrifugal force toward the wall and exit through the larger diameter outlet as the accepted fraction, while the remainder, to which the lights are segregated, is discharged as a smaller reject fraction via the inner outlet.

Such separators depend upon the centrifugal force which is generated by their vortex, which varies directly with speed at which the slurry travels its vortical path which, in turn, varies generally inversely with the diameter of the vortex. For this reason the modern art has trended toward small diameter cleaners in which the centrifugal force is high but the possible output for a given feed pressure is comparatively low, necessitating a large number of separators per treatment stage for the flow volume required by most paper or pulp mills. Since plugging problems also tend to be greater the smaller the diameter, a demand has arisen for interrelated design of separators and their manifolds in which the individual separators may be removed from their manifolds and replaced cleaned or with a new separator.

U.S. Pat. No. 3,861,532 discloses a system of separators and manifolds in which the individual separators may be placed in and removed from operative association with feed and output manifolds by insertion or withdrawal endwise through horizontally axially aligned round apertures lined with sealing material. In the system disclosed the separators may be removed without shutting off and draining the manifolds by attaching a new separator to one end of the separator to be replaced and pushing the assembly through the aligned sealing apertures until the new separator is in operative position and the now fully extruded initial separator can be detached.

SUMMARY OF THE INVENTION

Aforesaid U.S. Pat. No. 3,861,532 discloses for use in its system a hydrocyclone separator of the prior art type first mentioned above, in which the working parts are essentially a vortexing chamber which is conical for the greater part of its length to the small end outlet and a vortex finder for the reversing vortex with its inlet near the large end of the vortex chamber and having a long axial extension beyond the inlets to the vortex chamber, so that the inlets to the vortexing chamber are in the mid portion of the device. For use with the disclosed replaceable system of associating the separators with the manifolds, these working parts are enclosed within two hollow cylindrical shells screwed to opposite ends of a short intermediate cylindrical piece containing the inlets and a support for the vortex finder. These shells are dummy extra pieces except for side outlet openings near the sealed ends of the cylinders.

An object of this invention is to provide a separator of novel construction suitable for use in a system like that of the patent but in which the vortexing chamber is cylindrical, so that a cylindrical form of the body is a working form and no dummy parts need be added. A further object is to provide such a separator which is more efficient in separating the lights from the acceptable fiber fraction than the structure of aforesaid U.S. Pat. No. 3,306,444 and at least as efficient as the more recent modification of the structure of that patent also mentioned above.

In attaining this object, the invention provides a separator having an elongated tubular body with sealed ends and a cylindrical inner wall extending the major part of its length. A slurry feed inlet is formed by an apertured portion of said wall adjacent a first end of the body and is adapted to direct a flow of slurry under pressure in a vortical path along the wall towards the opposite second end of the body. An axial flow passage for the slurry adjacent this second end of the wall has an enlarged inlet facing the first end of the body, provided with a substantially circular rim spaced radially from the wall and functioning as a skimmer to remove an inner portion from the vortical slurry path, the wall providing a continuous vortical flow path from the slurry feed inlet to the rim. The slurry fraction flowing between the rim and the wall and the slurry fraction passing through the axial flow passage are discharged through respective apertured portions of the sidewall of the second end of the body. While the shape of the outer wall of the body is not functional in separation, it is preferably cylindrical and of non-uniform diameter for reasons hereinafter appearing.

Preferred embodiments may include an air core stabilizer at the inlet end, a conically shaped inlet to the axial flow passage, a detachable translucent portion for viewing the reject fraction passing to its outlet, a vortical flow path of effective length about 10 times the diameter of the body inner wall, a diameter of about 5 inches and a hollow cylinder forming most of the separator body to which are detachably connected the opposite end portions including the inlets and outlets and parts connected to them.

Another object of the present invention is to provide improvements over the system of co-related separator construction and manifolds with aligned sealing apertures in sidewalls for demountable assembly of the separators thereto such as disclosed for example in aforesaid U.S. Pat. No. 3,861,532.

The patent provides three side-by side manifolds which collectively embrace the entire length of the separator to its sealed ends, preventing access to mounted separators except at their ends. The feed manifold is in the middle and has sidewalls in common with the other two, which presents potential damaging leak problems if any seal in the common walls should fail, since the output fractions received in the side manifolds are at a drop in pressure compared to the feed pressure in the middle manifold, which is ordinarily at least 15 psi. While the patent indicates that these common walls could be replaced by separate walls, this would add half again as many sealing apertures.

In the system of this invention there are also three manifolds, but one end manifold is for the feed slurry and the other two are for the two output fractions, which makes it possible to use a shared sidewall between them without danger of any serious seal leakage because they are at approximately the same pressure drop from feed pressure. In addition, the feed manifold is spaced from the other two by at least substantially half the length of the associated separators. Advantage is taken of this spacing in two ways to greatly facilitate manipulation of separators for unplugging or replacement.

One way is by the external shaping of end portions of the separator bodies so that they are cylinders of uniform diameter for a length including their apertured portions greater than the width of the manifold or two manifolds with which they are to be associated but with a combined length less than half the total length of the body. Their diameter is such as to effect sealing engagement with the seal lined openings in the sidewalls of the manifold or manifolds with which they are respectively associated in operative position, while the intermediate body portion is of lesser diameter, such as to exert little or no pressure on the sealing rings when thrust through them. By this construction insertion or withdrawal of the separators is greatly facilitated and wear and tear on the seals is reduced.

The other way is to provide no supporting or other structure between the manifolds which would interfere with access to one side of the separator bodies between them for hand manipulation. To take full advantage of this arrangement, multiple sets of aligned seal-lined openings are arranged in two rows to provide only two stacks of the separators, each exposed at one side for such manipulation. Where more stacks of separators are required per manifold set, the advantage of side access will be confined to outer stacks after initial assembly.

BRIEF DESCRIPTION OF THE DRAWINGS

In the preferred embodiments illustrated in the drawings.

DESCRIPTION OF THE PREFERRED EMBODIMENTS

Figure 2:
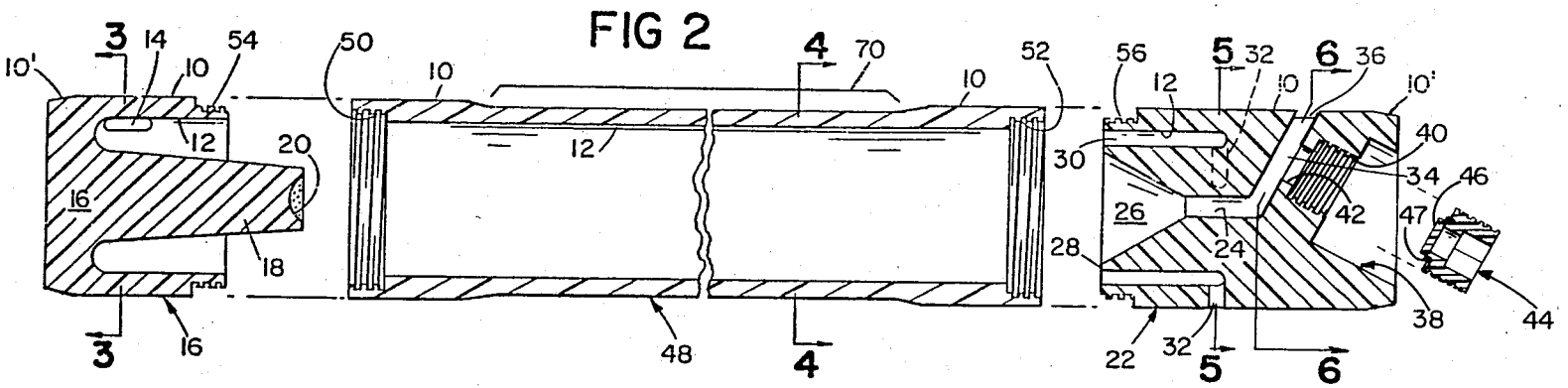
FIG. 2 is an exploded view of the separate parts shown fastened together in FIG. 1.
Figure 6:
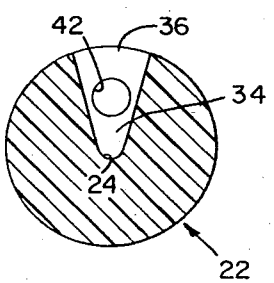
FIG. 6 is a cross-section view taken on line 6—6 of FIG. 2 looking in the direction of the arrows.
Figure 5:
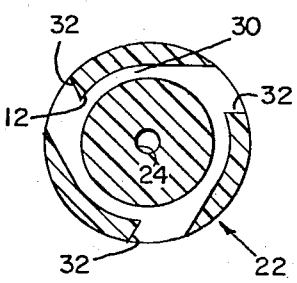
FIG. 5 is a cross-section view taken on line 5—5 of FIG. 2 looking in the direction of the arrows.

The separator embodiment shown in FIGS. 1–6 has an elongated body which has a cylindrical outer wall 10, with ends 10' beveled toward the axis. The body is hollow for most of its length to provide a continuous cylindrical inner wall 12 of uniform diameter. At one end this wall is apertured to provide an inlet shown as three tangentially directed inlet openings 14, the body having sufficient thickness so that these openings, with their outer ends immersed in feed slurry under pressure, direct a flow of the slurry tangentially onto the inner surface of inner wall 12. A vortical flow of the slurry about the body axis is thus induced toward the opposite end.

The inlet end of the vortex chamber defined by the wall 12 is formed by a closure member 16 which comprises an end portion of walls 10 and 12 containing the openings 14 and a solid sealing end integral therewith. Member 16 is preferably as shown provided with a post 18 projecting axially inwardly from its end of slightly tapering conical configuration, which extends a short distance beyond the openings 14 and has a generally spherically shaped depression 20 in its end facing the opposite end of the body which acts to retain and stabilize the axial air core which forms within the vortex.

The opposite end of the vortexing chamber formed by the inner wall 12 is provided with a closure member, designated generally 22, which has a central axial flow passage 24 with an enlarged inlet 26 facing the opposite end of the body. This enlarged inlet, preferably conically formed as shown, has its rim 28 spaced from wall 12 and lying within the vortex so that the rim acts as a skimmer to remove the inner portion of the vortex into the passage 24.

An annular slot 30 in member 22 surrounding passage 24 and inlet 26 receives the slurry fraction passing between the rim 28 and the wall 12 of which the outer wall of slot 30 forms a continuation and also forms a continuation of outer body wall 10. This outer wall is apertured adjacent its closed end to provide an outlet for the slurry fraction passing between rim 28 and wall 12, three equally spaced tangential openings 32 being shown for the purpose. Thus, this fraction of the slurry moves in a continuous vortical path along wall 12 from feed inlet openings 14 to outlet openings 32. Outlet openings 32 are elongated and arranged with their long axes circumferential to, and parallel to the vortical flow in, slot 30, which is important in preventing plugging by long fibers and fiber stringing.

Member 22 is provided with an outlet passage 34 communicating at one end with axial passage 24 and axially slanting and widening to an outlet opening 36 in the sidewall of member 22 between the adjacent end of said member and the outlet openings 32. This adjacent end of member 22 is provided with a recess 38 with a slanting sidewall so that its inner end is parallel to the adjacent slanting, widening wall of outlet passage 34. The inner end of recess 38 has a smaller diameter, internally threaded extension 40 which has a further yet smaller, smooth-walled extension 42, which opens through the adjacent wall of outlet passage 34.

Figure 1:
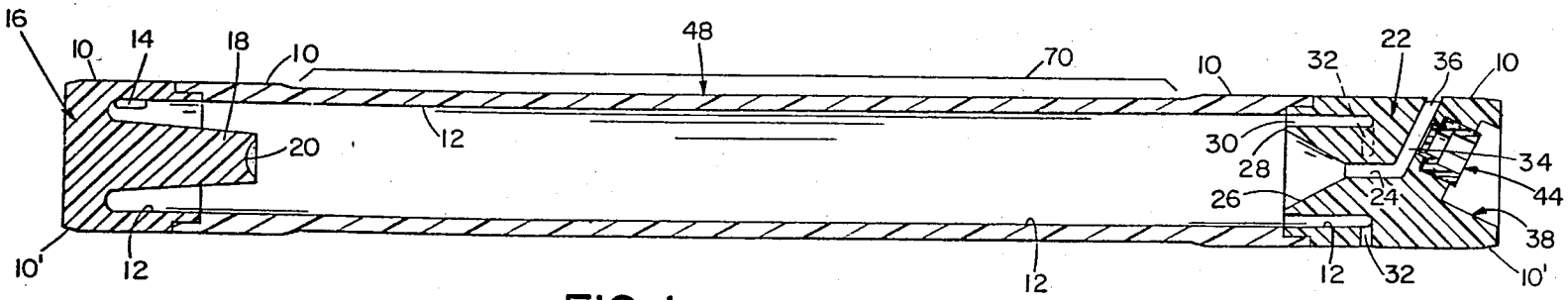
FIG. 1 is an axial longitudinal cross-section view of a hydrocyclone separator according to the invention.

A plug 44 of transparent material has a screw-threaded exterior to fit the threaded interior of extension 40, a hollow interior, and a concentric reduced projecting end 46 to fit into extension 42. End 46 has a flat closure which permits viewing the inside of outlet passage 34 through the hollow interior of plug 44 when the parts are assembled, as shown in FIG. 1. The interior wall of plug 44 has a hexagonal shape to facilitate manipulation. A sealing O-ring 47 surrounds the base of end 46. The removability of plug 44 facilitates access to the interior of outlet passage 34 through recess 38 and extensions 40 and 42 should plugging occur.

As shown and preferred, members 16 and 22 and the intervening portion designated generally 48, are separately formed and joined together at their ends. As shown particularly in FIG. 2, intervening portion 48, which constitutes most of the length of the separator body, is merely a hollow cylinder forming most of the length of walls 10 and 12. Its inner wall 12 terminates in enlarged screw threaded portions 50 and 52 at its respective ends. The outer wall 10 of member 16 terminates in a reduced externally threaded portion 54 which is screw threaded and threads into end portion 50 of section 48 so that its inner and outer wall portions 10 and 12 abut and form continuations of those of the section 48. Likewise, member 22 has its portion of wall 10 terminating in a reduced externally threaded portion 56 which threads into the screw threaded end 52 of member 48 so that its wall portions 10 and 12 abut and form continuations of parts of those walls contained in section 48. These parts may be fabricated of any suitable material such as metal or plastic but preferably each of the three parts is separately molded from a suitable plastic, such as polyurethane. These parts of the embodiment were custom molded of a modified rigid polyurethane by Walker Lund, Inc. of Bingley, England from which molded parts of this material are commercially available. Plug 44 was molded of modified, rigid and transparent polyethylene and was obtained from the same source.

In operation, the separator inlet apertures are immersed in a first manifold in feed slurry under pressure, typically about 20 to 30 p.s.i., which has preferably been pre-cleaned of any unacceptable amount of "heavies" but which contains an unacceptable amount of "lights". The two sets of outlet openings for the respective fractions are disposed in second and third manifolds which are connected to discharge separately from the system. With the system feed turned on, feed slurry flows into the three inlet openings of the separator which direct it vortically in the same direction about the body inner wall, merging as a single vortex. Multiple inlet openings are preferred as providing more uniform vortical flow than one or even two. The vortex flows without interruption along the inner wall until it comes to the rim of the enlarged inlet to the axial passage, which acts as a flow divider to split the flow into an outer vortex flowing between the rim and the wall into its receiving annular slot and out the outlets therefrom into the second manifold, and an inner vortex which flows vortically through the inlet to the axial passage, through that passage and then out the outlet passage into the third manifold.

The outer vortex contains preponderantly the desired fibers and is the larger. The smaller inner vortex contains preponderantly the "lights". The ratio between these two fractions is initially determined roughly as the ratio of the cross-sectional area of the axial flow passage to the cross-sectional area of the space between the axial passage inlet rim and inner wall. However, outlet manifolds are normally equipped with valves in their discharge connection as well as with back pressure indicating dials by means of which the back pressure of the two fractions in the separator can be adjusted. Thus, for example, the back pressure of the smaller fraction can be increased to reduce the percentage of slurry removed in the smaller fraction by reducing the flow through its manifold discharge valve to the desired volume.

Significant dimensions of the parts of an embodiment of the separator according to FIGS. 1–6 will now be set forth with comments, to assist in duplication or in modification to suit different requirements calling for some alteration.

The diameter of inner wall 12 was 5 inches. This diameter determines both the throughput volume and vortex centrifugal force available at a given feed pressure. The length of the vortical flow path from inlet openings 14 to rim 28 was approximately 53 inches, so the length to diameter ratio was about 10 to 1. This is the part of the length in which centrifugal force is effective to separate the solids into inner and outer fractions. Smaller diameters would have the advantage of greater centrifugal force in the vortex and so the possibility of somewhat greater efficiency and shorter flow paths and over-all length, but also disadvantages such as lower throughput and greater likelihood of plugging. With the diameter and flow path length indicated the separator proved to effect the desired "lights" separation more efficiently than three-way separators according to aforesaid U.S. Pat. No. 3,306,444 and equal to that reported for the later alternative two-way separator for "lights" described earlier herein, despite considerably smaller diameter of the latter. Since the attained efficiency was sufficient, the 5-inch diameter was used for other advantages it provides over smaller diameter and capacity separators.

The length of body section 48 (FIG. 2) was 50.3 inches, members 16 and 22 extended this by 4.85 inches and 8.23 inches, respectively, to an overall body length of 63.4 inches. The maximum outer diameter of the separator was 6.5 inches with a 10° bevel one-half inch long at each end and with a reduced diameter portion designated 70 between its maximum diameter end portions, described hereinafter in connection with the manifold embodiments.

The spacing of rim 28 from wall 12 was one-half inch and the diameter of flow passage 24 was 1.00 inch. Inlet openings 14 and outlet openings 32 were slots rounded at their ends as indicated in the drawings, the slots forming openings 32 having a transverse dimension in the circumferential direction of about 1.375 inches. Outlet passage 34 was inclined at 120° to axial passage 24 and enlarged toward outlet opening 36 so that opening 36 was an elongated circumferential slot with rounded ends extending 30° about the axis of member 22. Inlet 26 to passage 24 had a 60° cone angle. The external screw-threaded portion of plug 44 had a diameter of 2.25 inches.

Post 18 had a 2 inch diameter end spaced 4.76 inches from the nearest end of inlet openings 14. Depression 20 was generally formed to a spherical radius of 0.87 inches but had a roughened surface. A test unit in which the vortex chamber could be viewed showed that an air core forms centrally of the vortex extending between the post and the inlet end of axial flow passage 24, which remains substantially stable when its end is received in depression 20. Without such stabilization, the core had a tendency to gyrate about the vortex axis creating turbulence which impaired most efficient operation of the device.

The external shape of the separator shown is preferred for its use in a system in which the separators can be inserted to and removed from operative association with manifolds through axially aligned round seal-lined apertures in the manifold walls, such as the systems shown in FIGS. 7–11 now to be described. It should be understood, however, that the separator can have other shapes, such as a uniform outer diameter, which it would need to have in a manifold system designed for removal of separators while the manifolds are operating, such as the system shown in aforesaid U.S. Pat. No. 3,861,532.

Figure 8:
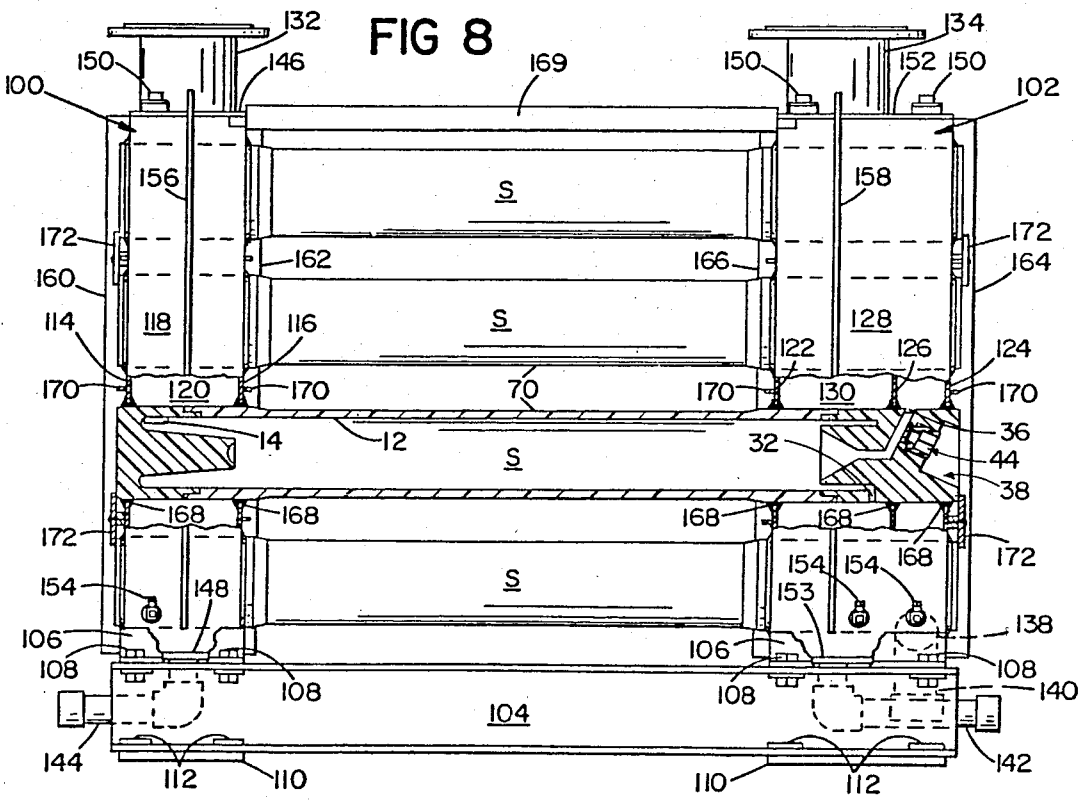
FIG. 8 is a side elevation view partly in cross-section of the device shown in FIG. 7.
Figure 7:
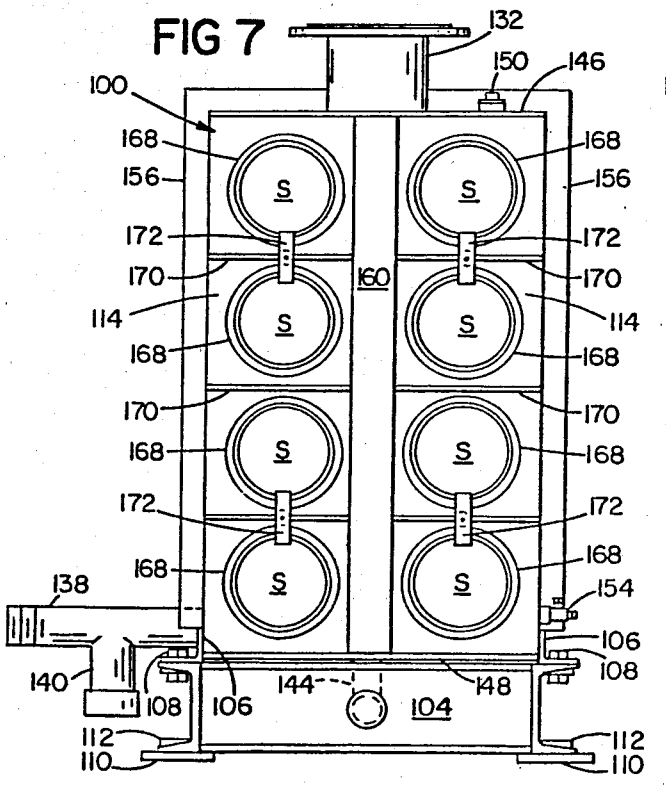
FIG. 7 is an end elevation view of multiple separator and common manifolds combination according to the invention.

The multiple separator and common manifolds embodiment shown in FIGS. 7 and 8, has two manifold structures designated generally 100 and 102 of rectangular, hollow box-like shape mounted with their longer dimension vertical, on a base 104, suitable for horizontal disposition which is preferred. Base 104 is a rectangular frame with angle iron sides on the ends of which the respective superstructures are mounted by means of angle brackets 106. One leg of brackets 106 is welded to the superstructure and the other leg rests on and is bolted to the upper leg of the U-shaped base sides by bolts 108 extending through mating apertures in the leg and secured by nuts as shown. Slight clearance is provided between the superstructure and the frame so its weight is supported by the angle brackets. The lower legs of the frame sides have flat foot bars 110 welded to the underside at its ends on which base 104 rests. This leg and bars 110 are provided with slots 112 for receiving anchor bolts (not shown) extended therethrough, for attachment to underlying structure such as a floor.

Structure 100 has parallel sidewalls 114 and 116 and parallel end walls 118 and 120 of a single manifold, which is the feed slurry manifold for separators according to FIGS. 1–6. Structure 102 has parallel sidewalls 122 and 124 with an intermediate parallel wall 126 and parallel end walls 128 and 130, defining sides and ends of two separate manifolds with a common sidewall 126. For separators according to FIGS. 1–6, the manifold having sidewalls 122 and 126 is for the larger, accepts fraction and the manifold having sidewalls 124 and 126 is for the smaller rejects fraction.

Manifold structure 100 has an inlet pipe 132 communicating with its interior and flanged for connection to a mating flange on the end of communicating piping (not shown) from the system source of feed slurry. The manifold defined between sidewalls 122 and 126 of structure 102 has an outlet pipe 134 communicating with its interior for connection to discharge piping (not shown). The manifold defined between sidewalls 124 and 126 of structure 102 has an outlet pipe 13 communicating with its interior for connection to discharge piping (not shown). Pipe 138 is at the bottom of its manifold and is provided in its underside with a branch pipe 140 which can be used to drain the manifold. The other manifold of structure 102 is provided with a bottom drain pipe 142 and the manifold of structure 100 is provided with a bottom drain pipe 144. Drain pipes 140, 142 and 144 are shown provided with screwed-on caps for removal and connections of the pipes to such drainage collecting system as the user wishes to provide.

The manifold of structure 100 has a top wall 146 and a bottom wall 148 welded respectively to the top and bottom of the sidewalls and end walls. Top wall 146 has an intermediate opening (not shown) around which inlet pipe 132 is secured and another opening (not shown) through which is threaded a vent valve 150 which is closed in normal operation but can be turned to admit air when the feed line to the manifold is closed down and the manifold is being drained or while it is filling. The two manifolds of structure 102 have a common top wall 152 and a common bottom wall 153 secured respectively to the top and bottom of their two outer sidewalls and intervening common sidewall and end walls. Outlet pipe 134 is secured around an opening (not shown) in the top wall 152 into the manifold defined between sidewalls 122 and 126, and the top wall is provided with a vent valve 150 for each of the two manifolds. A tap 154 with removable plugs is provided through one end wall of each manifold to which suitable hydraulic pressure indicating devices (not shown) may be attached.

Reinforcing bars 156 are welded to the top and end walls of structure 100 and similar bars 158 are welded to the top and end walls of structure 102 (one shown in FIG. 8). A U-shaped reinforcing bar 160 has its ope face welded at its sides and ends to the mid portion of the exposed face of sidewall 114 of structure 100, and like bar 162 is similarly welded to the exposed face of sidewall 116. Corresponding bars 164 and 166 are similarly welded to the exposed faces of sidewalls 124 and 122 respectively of structure 102 (FIG. 8). A tie bar 169 has end tabs welded respectively to the external faces of end wall 118 of structure 100 and of end wall 128 of structure 102. A similar tie bar (not shown) is provided between end wall 120 of structure 100 and end wall 130 of structure 102.

The manifold sidewalls 114, 116, 122, 126, and 124 are collectively provided with sets of axially aligned circular openings which have secured around their edges rings of flexible sealing material, the seal-lined openings being designated by the reference numeral 168, each sidewall having the corresponding seal-lined opening of each set. One such set is fully shown in section view in FIG. 8 while the sealing rings at one end of all sets in sidewall 114 is shown in elevation in FIG. 7. As indicated in FIG. 7, in the preferred embodiment shown there are 8 such sets of aligned seal-lined openings provided, arranged in two vertical columns of 4, all openings being as shown in FIG. 8.

The seal-lined openings 168 are of uniform diameter to receive the separators S, inserted endwise therethrough from either end to operative position, in which each end of the separator protrudes only slightly beyond the two outermost end seals, with the respective end outlets associated with the corresponding manifolds. The specific manifold structures shown in FIGS. 7 and 8 were designed and dimensioned for receiving separators designed and dimensioned in accordance with FIGS. 1–6, so that the aligned seals have an inner diameter slightly less than the maximum 6.5 inch outer diameter of the separator shown in those Figures and are expanded to that diameter when the separator is pushed through them, thus being in sealing engagement with the associated separator about its maximum diameter body portions when in operative position.

The separators S shown in FIGS. 7 and 8 are identical internally and externally with the separator according to FIGS. 1–6, as can be seen from the cross-section in FIG. 8. The body portion 70 lying between the manifold structures 100 and 102 in the operative position is of smaller diameter than the body ends for nearly the full length of such body portion, and includes beveled ends connecting to the larger diameter body ends. The length of smaller outer diameter portion 70 in the embodiment shown was 40 inches or nearly two-thirds of the total length of the body. The extent of reduction of diameter in the portion 70 need not be great and is preferably a few hundredths of an inch less than the unextended inner diameter of the seals but should be sufficient to substantially reduce or wholly relieve the exertion of expansive sealing force on the seals as it is moved through them. In the embodiment shown the diameter between the beveled ends was reduced 0.1 inch from 6.5 to 6.4 inches, which was slightly less than the unexpanded diameter of the seals. The advantages of this relief in seal wear reduction and greater ease of separator manipulation are significantly realized when the separator body is of such reduced diameter for at least substantially half its length.

As can be seen from FIG. 8, the distance between the two furthest spaced apart manifold sidewalls 114 and 124 is slightly less than the distance between the bevels at opposite ends of the separator body so that their seal-lined openings 168 surround separator portions of maximum diameter adjacent the respective bevels in operative position of the separator. Similarly, the two nearest manifold sidewalls 116 and 122 are spaced apart slightly more than the length of the reduced diameter portion 70 of the separator so that their seal-lined openings 168 surround maximum diameter separator portions adjacent each end of reduced diameter portion 70 of the separator. Intermediate wall 126 of the two manifolds is positioned so that its seal-lined opening 168 surrounds the separator portion of maximum diameter between the two outlets of the separator.

The outer faces of sidewalls 114 and 116 of structure 100 and of sidewalls 122 and 124 of structure 102 have welded thereto six reinforcing ribs 170, one midway between each pair of superposed seal-lined openings 168 and welded at one end to the adjacent side of the reinforcing bars 160, 162, 166 and 164, respectively. The upper and lower ribs 170 on sidewalls 114 and 124 have welded thereto, centrally between each vertical pair of seal-lined openings which they separate, internally threaded sockets to receive attachment screws through the centers of keeper plates 172. Plates 172, in the vertical position shown, retain the vertical pair of separators between which each is associated against accidental endwise movement from operative position. They may be turned to horizontal position to free the associated separators for movement through the seals.

In the embodiment shown, structural stainless steel was used throughout, of 3/16ths inch thickness for the manifold walls. The exposed faces of sidewall 114 of structure 100 and of sidewall 124 of structure 102 were spaced 61.5 inches apart. The distance between the facing sidewalls 116 and 122 of the two manifold structures was approximately 42 inches. The exposed faces of the top and bottom walls of the manifolds were spaced apart 37.75 inches. Sidewalls 114 and 116 of manifold structure 100 and sidewalls 122 and 126 of manifold structure 102 were spaced apart approximately the same distance to provide similar capacity for the feed and accepts manifolds defined between them respectively. The joints between separator member 48 and the two end members joined to it lie within these manifolds, so that any small leakage occurring at the joints would not be of consequence. The rejects manifold defined between sidewalls 126 and 124 of structure 102 had smaller capacity, corresponding to a spacing between these sidewalls of about half that of the other two manifolds. The axes of the sets of aligned seal-lined apertures were spaced apart approximately 9 inches vertically and 12 inches horizontally.

Since as shown the separators are supported solely by the manifolds of structures 100 and 102 and there is no structure between them except out-of-the-way base 104 and tie bars 169, there is full freedom of access for hand manipulation of the separator bodies from each exposed side of the two stack manifold structure shown. Forcing separators endwise entirely through the aligned seals is difficult and awkward, particularly with larger diameter separators, such as 4 inches or more. The pressure of the pressure-tight seals of such diameter is difficult to overcome. Assistance from the side can be of considerable advantage not only in original assembly but in replacing or working on separators in place.

The reduced diameter of the body between the two structures also greatly assists separator manipulation. A short push from either end will move a separator out of the seal at the end from which the push is given and will also move the smaller diameter portion of the separator into the one of the seals nearest it in the direction of motion. Thus approximately two-fifths of the seal pressure is removed for further movement in the same direction. By moving a separator less than a third of its length, all sealing pressure is relieved, so the separator can be moved further or rotated relatively freely. Both maximum diameter ends will be exposed so they can be worked on for unplugging, either externally or by unscrewing the end members from the intermediate section to get at the interior, so that deplugging without complete removal becomes relatively easy.

Also, it should be noted that four of the five sidewalls having the seal-lined openings are external walls of which the seals are visible and accessible for fast location and repair of leaks. The only internal wall with seal-lined openings is between manifolds under like pressure so that significant leakage through seals is unlikely.

For adequate access to separators the two manifold structures should be spaced apart at least substantially half the length of the separators. Two vertical stacks of separators a shown is preferred to afford access to both stacks. However, for installations involving such a large number of separators that two stacks per set of manifolds becomes uneconomical, or requires too much floor space for aisles between stacks, it is contemplated that two or more additional stacks of separators will be provided, the manifold sidewalls being correspondingly lengthened to receive the additional sets of seal-lined apertures. In such case, only the two outside stacks will have the advantages of body exposure for manipulation after the system has been installed. For initial installation of separators, inside stacks would share this advantage.

It will be understood that all inlet, outlet and drain connections to the manifolds provided at the site will be provided with suitable valves or caps for opening and closing each connection. With the construction shown, flow to the feed manifold must be shut off and each manifold should be drained, before any movement of separators is undertaken.

Figure 10:
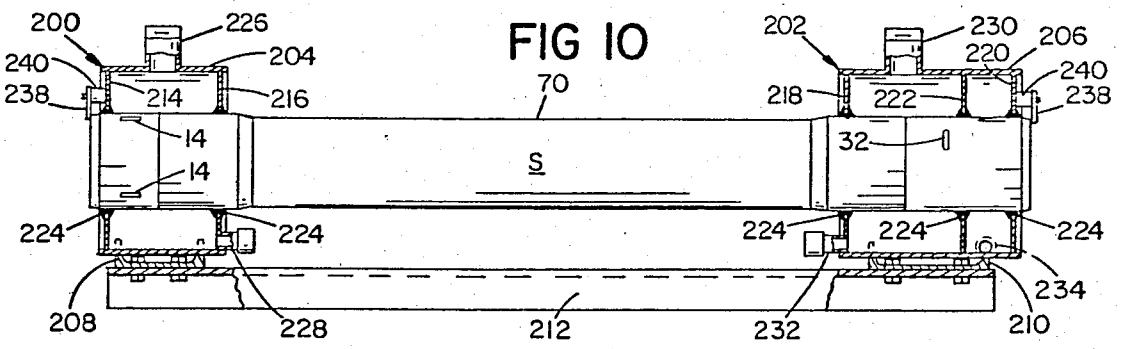
FIG. 10 is a longitudinal cross-section view of the device shown in FIG. 9.
Figure 9:
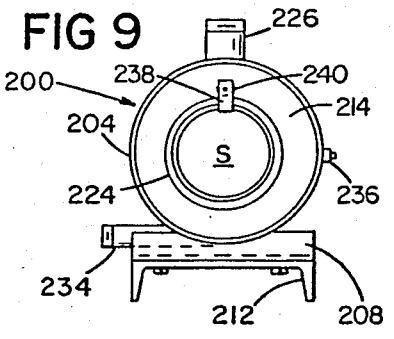
FIG. 9 is an end elevation view of a single separator and manifold combination according to the invention.

FIGS. 9 and 10 show a modification of the manifold structures of FIGS. 7 and 8, adapted to receive a single separator S, which is shown the same as separator S in FIGS. 7 and 8. One or more such single separator manifold structures may usefully be installed with a multiple separator manifold for test and performance comparison purposes.

The two manifold structures 200 and 202 of FIGS. 9 and 10 are in this case cylindrical and of the same diameter. The outer face of the cylindrical wall 204 and 206 of each structure respectively is welded near its ends to correspondingly curved depressions in the sidewalls of a pair of U-shaped support brackets 208 and 210, which are bolted near their ends to the top of inverted U-shaped support base 212 for both structures. Structure 200 has sidewalls 214 and 216 welded at their circular perimeters to the inside of cylinder 204. Structure 202 has outer sidewalls 218 and 220 and intermediate sidewall 222 similarly welded to the inside of cylindrical wall 206. The spacing of these sidewalls relative to each other and to the separator S is the same as in the FIGS. 7 and 8 embodiment and they are provided centrally with a single set of axially aligned, seal-lined apertures 224 which are the same as a corresponding set of such apertures 168 in FIG. 8.

The single manifold defined by structure 200 is the feed slurry manifold, provided at the top with inlet pipe 226 to receive valved connection (not shown) to the system and/or other desired feed source and a removably capped bottom outlet pipe 228 to receive valved connection (not shown) for drainage to a desired receiver. The accepts manifold having sidewalls 218 and 222 of structure 202 has an outlet pipe 230 at the top to receive valved connection (not shown) to the desired disposition of the accepts fraction and a removably capped outlet pipe 232 to receive valved connection (not shown) to a suitable drainage sump. The rejects compartment between sidewalls 220 and 222 of structure 202 is provided at the bottom with outlet pipe 234 to receive valved connection (not shown) to the desired disposition of the rejects fraction. Each of the three manifolds is provided in one side of its wall 204 or 206 with a removably plugged pipe 236 (the one for the accepts manifold only being shown in FIG. 9) communicating with the interior for receiving connection to suitable pressure indicating equipment (not shown). Single keeper plates 238 are mounted axially above the seal-lined opening in sidewall 214 of structure 200 and sidewall 220 of structure 202, respectively, each plate having its screw fastened in the screw threaded opening of mounting 240 welded to the exposed face of the wall.

The single separator embodiment may be used for various purposes. Thus it can be used as a guide for the best relative adjustment of the outlet valves of the accepts and rejects manifolds for any actual or contemplated slurry feed make up, or for tendency of any given slurry to plug more than others. Its performance on the same slurry can be compared with system performance as a check on whether all separators of the latter are functioning as they should. It can be used to experiment with interior changes in the separator and can be connected to and disconnected from the main system without material effect thereon.

Figure 11:
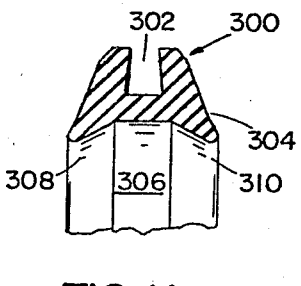
FIG. 11 is a fragmentary cross-section and inside elevation view of a seal employed in the FIGS. 7–10 embodiments.
Figure 4:
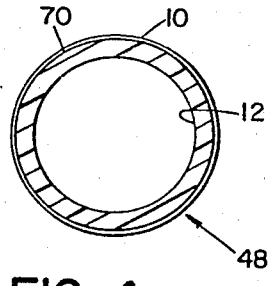
FIG. 4 is a cross-section view taken on line 4—4 of FIG. 2 looking in the direction of the arrows.
Figure 3:
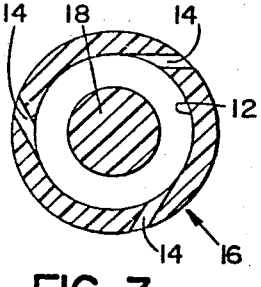
FIG. 3 is a cross-section view taken on line 3—3 of FIG. 2 looking in the direction of the arrows.

The seals used for the seal-lined openings in the manifold sidewalls of the embodiments shown in the drawings were purchased, these being commercially available Buna N Rubber 80–85 Shore A. The seals are shown in cross-section and inside partial elevation in FIG. 11 on a larger scale than in the other Figures. As shown in FIG. 11, the outer body part 300 of the annular seal is divided centrally by a coaxial slot 302 which is slightly wider at its base than at its open end so that the manifold wall surrounding the opening with which the seal is associated has to be forced into it. The inner body part 304 of the seal is concave toward the opening with a central cylindrical part 306 and two side extensions 308 and 310 angled inwardly toward the seal axis, these extensions forming the widest part of the seal at their tips, which are spaced apart unextended 1 inch. These tips unextended have a diameter of 6.42 inches which is 0.02 inch larger than the diameter of reduced diameter body portion 70 of the separators and is 0.08 inch smaller than the diameter to which they would be extended by the maximum diameter body portions of the separator passing through the seal or in operative position. Slot 302 is about 0.3 inch deep.

It should be understood that while the manifold embodiments shown were designed for and are shown containing separator embodiments according to FIGS. 1–6, the manifold embodiments could be used with other separators of the same external shape but differing internally from the separator embodiment and/or differing in diameter and axial length therefrom (with adjustments from dimensions given herein where required). It is advantageous to have the two apertured portions near one end of the separator function as outlets but this is not essential. Reduced diameter of the separator to the extent and for the length indicated is advantageously utilized with the spaced apart manifolds as shown but can also be advantageously used without such spacing. Arrangement of manifolds for horizontal disposition of multiple separators assembled thereto is preferred for maximum ease of separator manipulation but is not required.

I claim:

1. Hydrocyclone separator apparatus including at least one hydrocyclone separator for separating a fibrous slurry into two fractions of solids composition differing from each other in response to centrifugal force, said separator comprising:

an elongated body with sealed ends having three axially spaced portions of its sidewall apertured to provide respectively an inlet for feed slurry and respective outlets for the two separated fractions thereof, one of said apertured portions being adjacent one sealed end and another of said apertured portions being adjacent the opposite sealed end of said body;

and manifold structure for demountably receiving said separator comprising:

a slurry feed manifold and two outflow manifolds for respective association with said three apertured body portions of said separator, arranged with their sidewalls in parallel with one another;

axially aligned seal-lined openings through all of said manifold sidewalls of shape and diameter such that said separator may be pushed endwise through all of said openings to an operative position in which the sealing material of all of said apertures is in sealing engagement with said separator body;

the sidewall spacing of said respective manifolds being such that in said operative position of said separator the seal-lined apertures of the sidewalls of each manifold are sealingly engaged around corresponding portions of said separator body at opposite sides of the respective apertured portion of said body intended to communicate with said manifold;

the body of said separator being reduced in outer diameter between said corresponding portions sufficiently to exert substantially no sealing pressure on the seals when moved through them, at least half the length of said separator body being of said reduced diameter.

2. Hydrocyclone apparatus according to claim 1 wherein one of said end-adjacent apertured portions of said separator body is its inlet, said other apertured portions are located adjacent each other, the outflow manifolds associated with said other apertured portions are side by side with a common sidewall between them and are spaced at least substantially half the body length of said separator from said feed manifold, and the separator body portion lying between said feed and other manifolds when in operative association therewith is of said reduced outer diameter for substantially its entire length.

3. Hydrocyclone apparatus according to claim 1 which includes a plurality of said separators and said manifold sidewalls have a plurality of sets of said aligned seal-lined apertures.

4. Hydrocyclone separator apparatus including at least one hydrocyclone separator for separating a fibrous slurry into two fractions of solids composition differing from each other in response to centrifugal force, said separator comprising:

an elongated body with sealed ends, the sidewall of said body having an apertured portion adjacent one end of said body and having two axially spaced adjacent apertured portions near its opposite end, one of said apertured portions forming an inlet and the other two of said apertured portions forming respective outlets for said two fractions; and manifold structure comprising:

a single manifold and two side-by-side manifolds arranged with their sidewalls in parallel with one another and with the sidewalls of said single manifold, and with their sidewall nearest said single manifold spaced therefrom at least substantially half the length of said separator body, one of said manifolds being for feed slurry and the other two being outflow manifolds for separated slurry fractions;

axially aligned seal-lined openings through all of said manifold sidewalls of a shape and size such that said separator may be pushed endwise through all of said openings to an operative position in which the sealing material of all of said apertures is in sealing engagement with said separator body;

the sidewall spacing of said respective manifolds being such that in said operative position of said separator the said apertured portions thereof are between the sidewalls of corresponding said manifolds;

said manifold structure exposing the body portion of said separator between said single manifold and other manifolds in operative position for hand manipulation relative to said seal-lined openings.

5. Hydrocyclone apparatus according to claim 4 wherein said single manifold is the slurry feed manifold.

6. Hydrocyclone separator apparatus according to claim 4 which includes a plurality of said separators and wherein said manifold sidewalls have a plurality of sets of said aligned, seal-lined openings therethrough.

7. Hydrocyclone separator apparatus according to claim 6 wherein said sets of aligned, seal-lined openings are arranged in a plurality of rows to provide a plurality of stacks of separators in operative association therewith.

8. Hydrocyclone separator apparatus according to claim 7 which includes only two of said rows.

9. Hydrocyclone separator apparatus according to claim 7 wherein said rows are vertically disposed to provide stacks of superposed, horizontally disposed separators in association therewith.

10. Hydrocyclone separator apparatus according to claim 9 which includes only two of said rows.

11. Hydrocyclone separator apparatus according to claim 4 wherein the portion of said separator body which, when the separator is associated with said manifolds, is exposed between said single manifold and said other manifolds, is of reduced diameter for substantially its entire length relative to the portions of said separator body engaging said seals, said reduced diameter being such that said exposed body portion exerts substantially no sealing pressure on said seals when moved through them.

* * * * *

UNITED STATES PATENT AND TRADEMARK OFFICE

CERTIFICATE OF CORRECTION

PATENT NO. : 4,605,495

DATED : August 12, 1986

INVENTOR(S) : Peter J. Flynn

It is certified that error appears in the above-identified patent and that said Letters Patent are hereby corrected as shown below:

Column 1, line 1, after "in", insert a hyphen.

Column 1, line 14, after "paper", insert a hyphen.

Column 1, line 63, after "two", insert a hyphen.

Column 8, line 30, "13" should be --138--.

Column 8, line 65, "ope" should be --open--.

Signed and Sealed this

Eleventh Day of November, 1986

*Attest:*

DONALD J. QUIGG

*Attesting Officer*

*Commissioner of Patents and Trademarks*